United States Patent [19]

Thorsted et al.

[11] Patent Number: 4,497,460

[45] Date of Patent: Feb. 5, 1985

[54] ERODALE SPIN TURBINE FOR TUBE-LAUNCHED MISSILES

[75] Inventors: Kenneth G. Thorsted, Fredericksburg; John W. Pennington, Spotsylvania, both of Va.

[73] Assignee: The United States of America as represented by the Secretary of the Navy, Washington, D.C.

[21] Appl. No.: 478,747

[22] Filed: Mar. 25, 1983

[51] Int. Cl.[3] ..... F42B 13/24

[52] U.S. Cl. ..... 244/3.3; 102/374; 244/3.23

[58] Field of Search ..... 102/380, 374; 244/3.23, 244/3.3, 3.29, 3.24, 3.22

[56] References Cited

U.S. PATENT DOCUMENTS

| | | | |
|---|---|---|---|
| 579,035 | 3/1897 | Bell . | |
| 2,405,415 | 8/1946 | Eksergian . | |
| 2,426,239 | 8/1947 | Renner . | |
| 2,500,537 | 3/1950 | Goddard . | |
| 2,545,496 | 3/1951 | Short . | |
| 2,611,317 | 9/1952 | Africano . | |
| 2,924,174 | 2/1960 | McLean . | |
| 2,938,430 | 5/1960 | Pion . | |
| 3,063,376 | 11/1962 | Powell | 244/3.23 |
| 3,098,447 | 7/1963 | Hosli . | |
| 3,267,854 | 8/1966 | Michelson . | |
| 3,333,790 | 8/1967 | Durand . | |
| 3,343,766 | 9/1967 | Biehl et al. . | |
| 3,367,113 | 2/1968 | Mainhardt . | |
| 3,414,217 | 12/1968 | Kesting . | |
| 3,561,362 | 2/1971 | Black et al. | 102/374 |
| 3,964,696 | 6/1976 | Orzechowski et al. . | |
| 4,176,487 | 12/1979 | Manis . | |
| 4,194,706 | 3/1980 | Detalle . | |
| 4,203,569 | 5/1980 | Marks . | |
| 4,232,843 | 11/1980 | Clark et al. | 244/3.29 |

FOREIGN PATENT DOCUMENTS

| | | | |
|---|---|---|---|
| 1056728 | 3/1954 | France | 244/3.23 |

OTHER PUBLICATIONS

D. L. Booker, *Free Flight Rocket Spin Technique Development,* Techical Report, U.S. Army Missile Research and Development Command, pp. 1–90, Jan. 9, 1978.

*Primary Examiner*—Harold J. Tudor

*Attorney, Agent, or Firm*—Robert F. Beers; Kenneth E. Walden

[57] ABSTRACT

An erodable spin turbine having a plurality of turbine blades affixed to the outer periphery of a missile nozzle. When the missile is fired in its launch tube the exhaust gas stream flows across the turbine blades to impart an angular torque to the missile as it traverses the launch tube. As the missile traverses the launch tube the exhaust gas stream is also eroding the spin turbine such that when the missile exits the launch tube the missile has reached its terminal spin rate and the spin turbine is effectively eroded so that it no longer interacts with the exhaust gas stream. The spin rate of the missile in its free-flight trajectory is maintained by airflow over canted fins and canards mounted on the missile's airframe.

3 Claims, 13 Drawing Figures

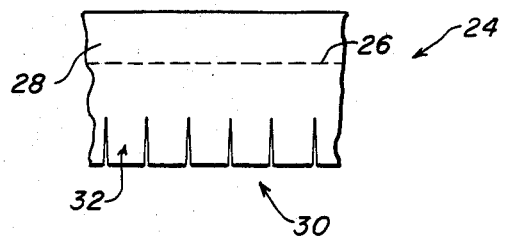
FIG. 4a
FIG. 4b
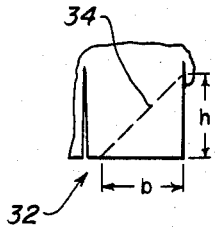
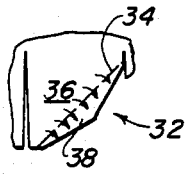
FIG. 4c
FIG. 4d
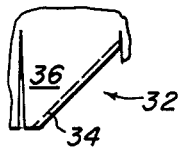
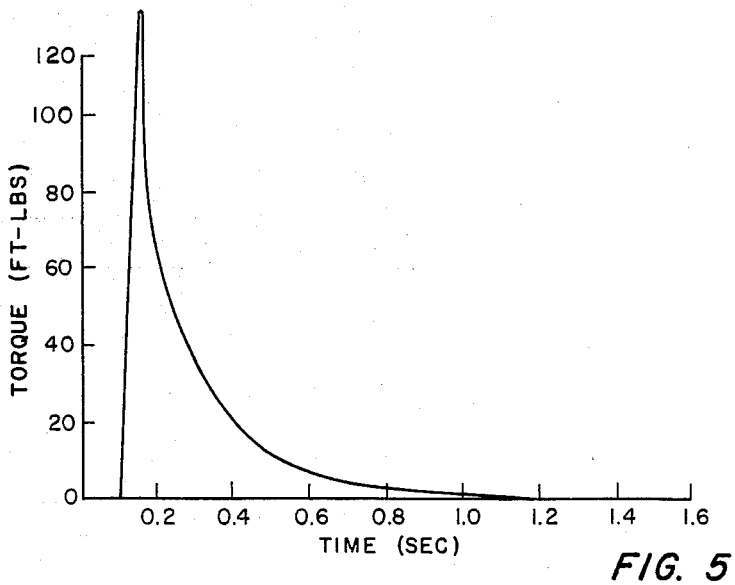
FIG. 5
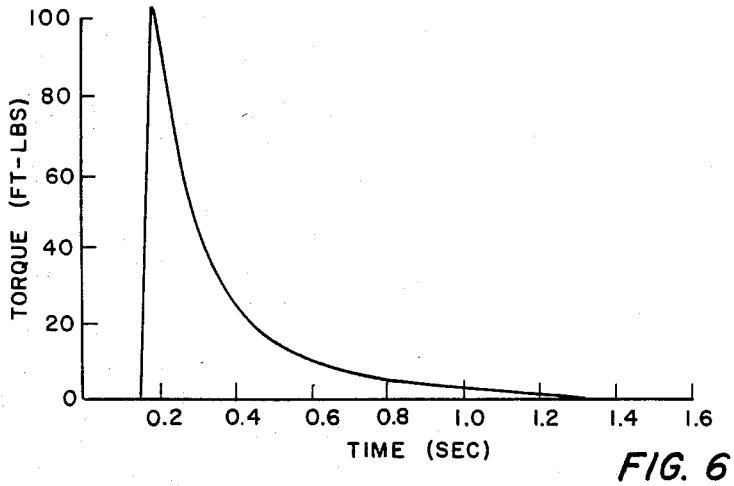
FIG. 6

ERODALE SPIN TURBINE FOR TUBE-LAUNCHED MISSILES

BACKGROUND OF THE INVENTION

This invention relates generally to missiles adapted to be launched from a launch tube and more particularly to an erodable spin turbine mounted on the periphery of the missile nozzle to impart spin to the missile during the launch phase.

Atmospheric free-flight missiles are spin stabilized to enhance their targeting accuracy by reducing ballistic dispersion resulting from nozzle defects and asymmetries in the thrust-producing exhaust gases; spin stabilization is also required for missiles with internal guidance systems. The missile velocity at the exit of the launch tube is generally insufficient to achieve adequate spin stabilization due to the airflow over the aerodynamic foils mounted on the missile's airframe; this results in an initial perturbation of the trajectory until aerodynamic spin stabilization is achieved. Therefore it has been necessary to devise means for imparting angular momentum to the missile during the launch phase so that as the missile exists the launch tube it is spin stabilized at the free-flight spin rate and the spin rate thereafter is maintained aerodynamically.

The prior art is replete with means for imparting an angular torque to a missile during its launch phase so that it is spin stabilized as it exits the launch tube. One solution to providing spin stabilization during the launch phase is to provide a launch tube with interior helical guides or grooves that the missile's aerodynamic foils ride against, so that as the missile traverses the launch tube a spin is imparted to the missile. The spin rate imparted to the missile is a function of launch velocity and helix angle. Exotic manufacturing techniques are required to produce launch tubes with helical guides or grooves which increases the per-unit cost of the missiles. This limitation is amplified when it is noted that in many applications of tube-launched missiles the launch tube is used only once. In addition, this device requires a machined clamp ring bore lay to prevent missile balloting as it traverses the launch tube; this also increases the production expense.

Canted fins or helical flutes may be inserted in the nozzle to deflect a portion of the exhaust gas stream thus imparting an angular torque to the missile. The major limitation of these devices is the loss of axial thrust due to the portion of the exhaust gas stream which impinges on these deflection surfaces. Even if the deflection surfaces are designed to burn out early in the missile's flight trajectory, asymmetrical thrust may be generated due to nonuniformity in burn out of the deflection surfaces. The cost and difficulty of production is increased for nozzles having internal deflection surfaces.

Another solution is a consumable insert for the nozzle so that the exhaust gas stream may initially be directed tangentially to the axis of the missile to impart spin to the missile. As the insert is consumed a greater portion of the exhaust gas stream is ejected axially until the insert is totally consumed at which time all of the exhaust gas stream is directed axially. A major limitation of such a device, however, is the loss of axial thrust during the launch phase, and the possibility of asymmetrical thrust generation due to nonsymmetric consumption of the insert. Since the insert must be manufactured with precision to ensure symmetrical thrust the overall cost of the missile will increase. A retaining means must also be produced to hold the insert in the nozzle which adds to the per-unit cost of the missiles. Additional time and effort is required to integrate the consumable insert and retaining means within the missile nozzle.

Deflection surfaces, attached to the outer surface of the nozzle and held in a retracted position by the launch tube so that the exhaust gas stream impinges upon the retracted deflection surfaces, may be used to impart an angular torque to a missile during the launch phase. In one alternative, as the missile exits the launch tube the centrifugal force generated by the spinning missile causes the deflection surfaces and their attachment means to be ejected from the missile. This separation can be hazardous to equipment or personnel in the vicinity of the launcher; the separation may also cause a perturbation in the trajectory of the missile. In the other alternative the deflection surfaces are withdrawn from the exhaust gas stream by a bias means as the missile exits the launch tube, but remain attached to the missile. A disadvantage of these devices is that they have a negative effect on the aerodynamic characteristics of the missile. At a minimum the coefficient of drag of the missile will be increased; the deflection surfaces may also cause asymmetric aerodynamic forces to act on the airfoils to increase the ballistic dispersion of the missiles. Either type of deflection device increases the cost and complexity of producing the missile, and as the number of mechanical elements is increased the reliability of the missile decreases.

Finally a separate gas stream may be directed to canted surfaces on the airframe of the missile to impart an angular torque to the missile in the launch tube. This method requires auxiliary equipment to generate the gas stream which increases the cost of the system; also the launch tube must be modified to function with this system which will increase the cost of the system. If the canted surfaces remain on the airframe during the free-flight trajectory negative aerodynamic forces will act on the missile. If the canted surfaces are consumable there is a likelihood that the airframe of the missile will also be scored as the canted surfaces are consumed.

SUMMARY OF THE INVENTION

The present invention surmounts the disadvantages and limitations of the prior art by means of a spin turbine in the form of a cylindrical sleeve. The forward portion of the sleeve is secured to the outer periphery of the missile nozzle. Turbine blades are formed at the aft end of the sleeve and configured so that exhaust gas flow over the turbine blades generates lift forces which impart an angular torque to the missile. The composition and configuration of the spin turbine are selected so that the spin turbine is effectively eroded by the exhaust gas stream when the missile exits the launch tube.

It is therefore a primary object of this invention to provide a spin turbine of simplified, inexpensive construction for imparting angular torque to a tube-launched missile during its launch phase.

Another object of this invention is to provide a spin turbine in the form of a cylindrical sleeve which can be readily secured to a missile nozzle or airframe.

A further object of this invention is to provide a spin turbine with erodable vanes so that the spin turbine acts to impart an angular torque to a tube-launched missile only during the launch phase.

Yet a further object of this invention is to provide a spin turbine which minimally disrupts the missile's exhaust gas flow stream so that there is a negligible loss of axial thrust.

Still a further object of this invention is to provide a spin turbine which is readily adaptable for use with any tube-launched missile.

BRIEF DESCRIPTION OF THE DRAWINGS

Other objects, advantages and novel features of the invention will become apparent from the following detailed description of the invention when considered in conjunction with the accompanying drawings wherein:

FIG. 4*a* is a plan view of the spin turbine showing the tabs.

FIG. 4*b* is an plan view of a tab showing the diagonal bend line.

FIG. 4*c* is a plan view of a tab showing a tab being bent about the diagonal bend line.

FIG. 4*d* is a plan view of a finished turbine blade.

FIG. 5 is the torque-time plot for test motor 1.

FIG. 6 is the torque-time plot for test motor 2.

PREFERRED EMBODIMENT OF THE INVENTION

Figure 1:
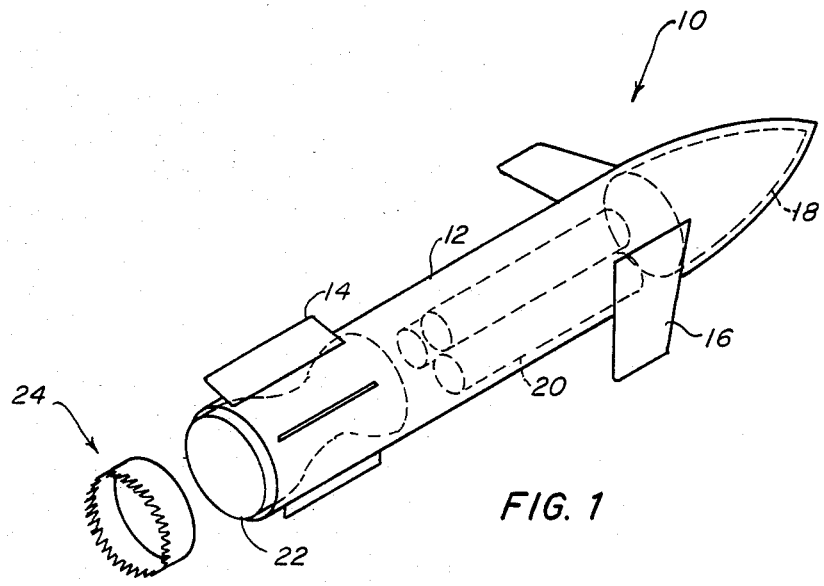
FIG. 1 depicts an exploded perspective view of a typical tube-launched missile and the spin turbine.

Referring now to the drawings wherein like reference characters designate identical or corresponding elements throughout the several views, FIG. 1 depicts the general configuration of a tube-launched missile 10 with an exploded view of a spin turbine 24. The airframe 12 has externally-mounted canted fins 14 and canards 16 to maintain the spin rate of the missile during its free-flight trajectory. As shown the canted fins 14 and canards 16 are rigidly mounted on the airframe 12 so that the inside diameter of the launch tube (not illustrated) must be of such dimension as to receive the furthest extending airfoil of missile 10. In the alternative the canted fins 14 and canards 16 could be in a retracted position while the missile 10 is disposed within the launch tube so that the inside diameter of the launch tube would be approximately that of the airframe 12; as the missile 10 exits the launch tube the canted fins 14 and canards 16 would be extended to the free-flight configuration by a bias means. Disposed within the forward end of the airframe 12 is a payload 18. The propellant grain 20 is disposed within airframe 12 aft of payload 18. In FIG. 1 the propellant grain 20 is depicted as a plurality of tubular grains; it is understood that the propellant grain 20 could be multiple-perforated grains, multiple grains, cruciform grains, internal star grains or any other configuration known in the prior art. The propellant grain 20 is ignited (means of ignition not shown) and the combustion gases travel axially rearward, undergoing expansion in the convergent-divergent nozzle 22 and exiting through spin turbine 24 into the atmosphere. The mass flow of the combustion gases and the pressure differential developed at the nozzle 22 exit generate the thrust to propel the missile 10.

Figure 2A:
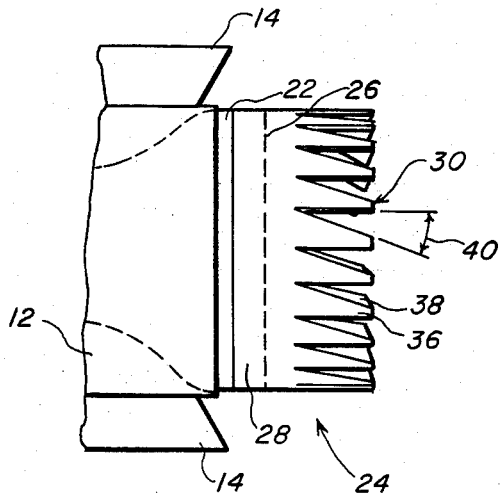
FIG. 2*a* is a side view of the spin turbine secured to a missile nozzle.
Figure 2B:
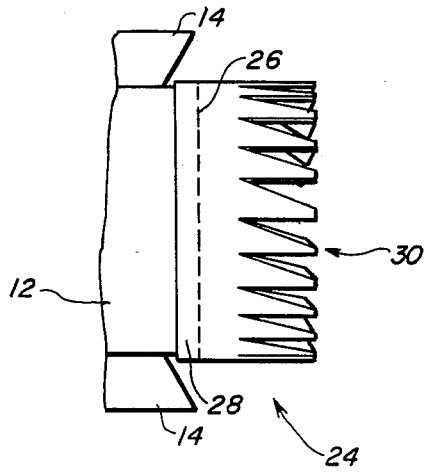
FIG. 2*b* is a side view of the spin turbine secured to a missile airframe.

In FIG. 2*a* the spin turbine 24 is shown secured to a convergent-divergent nozzle 22. FIG. 2*b* depicts an alternative embodiment wherein the spin turbine 24 is secured to the airframe 12 of the missile 10. This embodiment is efficacious where the configuration of the missile is such that the spin turbine 24 cannot readily be secured to the nozzle, e.g., where the missile has a plurality of nozzles instead of a single nozzle or where a single nozzle is disposed within the airframe of the missile.

Figure 3:
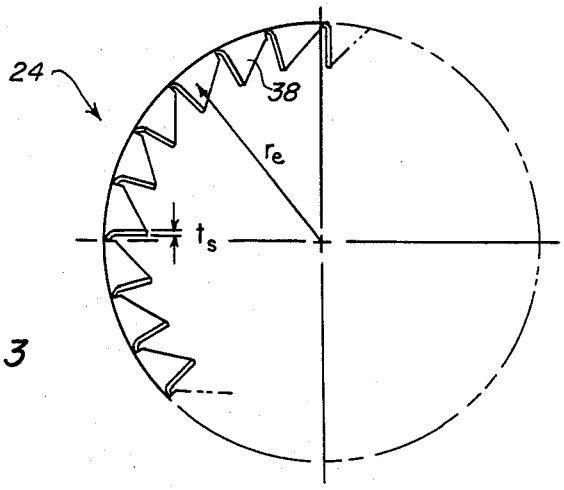
FIG. 3 is an axial view of the spin turbine.

The spin turbine 24 depicted in FIG. 2*a* is a one-piece cylinderical sleeve having a thickness $t_s$ (see FIG. 3). The cylinderical sleeve is further segmentally defined by a reference line 26 which divides the cylinderical sleeve into a forward portion, the skirt portion 28, and an aft portion having formed therefrom a plurality of turbine blades 30. The reference line 26 defines a plane perpendicular to the axis of the spin turbine 24 where the convergent-divergent nozzle 22, or in the alternative embodiment the airframe 12, terminates within the spin turbine 24 (FIGS. 2*a*, 2*b*). The skirt portion 28 is fixedly secured to the external periphery of the convergent-divergent nozzle 22 at its exit end, or in the alternative embodiment to the external periphery of the airframe 12 at the nozzle end, by a plurality of spot welds. Alternatively, any other conventional attachment means could be used to fixedly secure the skirt 28 to the nozzle 22, or the airframe 12.

The turbine blades 30 are formed from the aft end of the cylinderical sleeve. To form the turbine blades 30 a plurality of axial slits are made in the aft end of the cylindrical sleeve to define a plurality of tabs 32 (FIG. 4*a*). Between adjacent axial slits, on each tab 32 formed therebetween, a diagonal bend line 34 is defined such that a base b, and a length h, are defined (FIG. 4*b*). The tabs 32 are then partially bent inwardly approximately 90° about bend line 34 to form a plurality of neutral vanes 36 and a plurality of lift vanes 38 (FIGS. 4*c*–4*d*). Each turbine blade 30 is comprised of a neutral vane 36 and a lift vane 38. The neutral vanes are colinear, integral extensions of the skirt portion 28 and lie parallel to the axial flow of the exhaust gas stream. The lift vanes 38 are triangularly shaped, having a base b and a height h, and are obliquely disposed within the exhaust gas stream such that an angle of attack 40 ($\alpha$) is defined between the plane of a lift vane 38 and the axial flow of the exhaust gas stream (FIG. 2*a*). The exhaust gas flow over the lift vanes 38 generates lift forces L which act perpendicular to the plane of the lift vanes 38. A component of these lift forces L, defined by L cos (angle of attack 40), $L_T$, acts to impart an angular torque to the missile 10.

The torque required to spin a missile is $$T = I\left(\frac{w}{t}\right) 2\pi$$

where I is the moment of inertia of the missile, w is the required spin rate, and t is the travel time of the missile in the launch tube. For a given tube-launched missile system, I, w and t will be known design parameters so that the torque required may be calculated. With the torque, T, known, the lift that must be generated by the turbine blades 30 can be computed by $$L_T = \frac{T}{r_e}$$

where $L_T$ is that component of the total lift, L, generated by the lift vanes 38 of the turbine blades 30 which acts to impart an angular torque to the missile 10, and $r_e$ is the turbine blade center of pressure radius. For triangular-shaped lift vanes 38 the turbine blade center of pressure coincides with the triangle's center of gravity which may be empirically determined. Once $L_T$ has been determined the formulas for the lift forces generated by supersonic flow over an airfoil can be used to define the dimensions of the lift vanes 38 and the angle of attack 40:

$$L_T = C_1 \cdot q \cdot S$$

$$C_1 = \frac{4\alpha}{\sqrt{M^2 - 1}}$$

$$q = \tfrac{1}{2} \cdot \rho \cdot V^2$$

$$S = \tfrac{1}{2} \cdot N \cdot b \cdot h$$

where $C_1$ is the coefficient of lift of the lift vanes 38 of the turbine blades 30, S is the surface area of the lift vanes 38 which generate lift component $L_T$, $\alpha$ is the angle of attack 40 of the lift vanes 38, M is the mach number of the exhaust gas stream, $\rho$ is the density of the exhaust gas stream, V is the velocity of the exhaust gas stream, N is the number of turbine blades 30, b is the base length of an individual turbine blade, and h is the height of an individual turbine blade. For a given tube-launched missile system with a defined propellant grain the parameters $\rho$, V and M can be determined from the NASA-Lewis CEC 72 Equilibrium Thermochemistry Computer Program which defines the exhaust gas characteristics. Therefore the turbine blade parameters may be determined from the formula $$N \cdot b \cdot h \cdot \alpha = \frac{L_T \sqrt{M^2 - 1}}{2\rho V^2} \quad (1)$$

Some additional constraints will further define the configuration of the turbine blades 30. For a defined tube-launched missile system where $r_e$ is a known parameter $$N \cdot b = 2 \cdot \pi \cdot r_e \quad (2)$$

To reduce potential thrust misalignment due to the unsymmetrical erosion of the turbine blades 30, or engendered by the launch tube, the number of turbine blades is selected so that $$N \geqq 10 \quad (3)$$

Supersonic flow over an airfoil also generates a drag force which is proportional to the angle of attack 40 of the lift vanes 38 of the turbine blades 30; therefore to keep the drag force to a minimum, the angle of attack 40 is selected such that $$\alpha \leqq 20^\circ \quad (4)$$

Values for N, $\alpha$, b, and h may be selected under the constraints imposed by equations 2, 3 and 4 and substituted into equation 1. When the equality of equation 1 is met the configuration of the turbine blades 30 will be defined which will impart the required angular torque to the missile during its launch phase.

As the missile 10 traverses the launch tube the lift vanes 38 of the turbine blades 30 are in a continuous process of being eroded due to the temperature and kinetic energy of the exhaust gas stream impinging upon the lift vanes 38. The configuration of the lift vanes 38, b and h, and the thickness of the spin turbine 24, $t_s$, are selected so that the lift vanes 38 are effectively eroded as the missile 10 exits the launch tube. With the lift vanes 38 effectively eroded, the spin turbine 24 no longer interacts with the exhaust gas stream, the neutral vanes 36 being parallel to the axial flow of the exhaust gas stream, so that there is no perturbation or abatement of the thrust generated by the exhaust gas stream. A secondary burnthrough mechanism also ensures that the spin turbine 24 no longer interacts with the exhaust gas stream. As the exhaust gas stream exits the nozzle 22, the outer periphery of the exhaust gas stream follows the contour of the convergent-divergent nozzle 22. At reference line 26 there is a physical discontinuity between the convergent-divergent nozzle 22 and the spin turbine 24 which causes an eroding action along reference line 26 due to the kinetic and thermal energy of the exhaust gas stream impinging upon the inner wall of the spin turbine 24. At some time after the missile 10 exits the launch tube the spin turbine 24 is completely eroded along reference line 26 and the aft portion of the spin turbine 24 containing the neutral vanes 38 of the turbine blades 30 is ejected.

The spin rate generated by this invention is a function of angular torque, not launch velocity; therefore this invention provides a uniform angular torque to a missile 10 regardless of variations in thrust inasmuch as both the erosion rate of the lift vanes 38 of the spin turbine 24 and the angular torque generated are proportional to rocket motor thrust. If the rocket motor thrust is higher than nominal, the angular torque generated is higher but for a shorter time due to a higher erosion rate which causes the lift vanes 38 to be effectively eroded in a shorter time; the converse is also true. The net result is that the total torque generated by lift vanes 38 remains constant, i.e., the area under an empirical torque-time plot remains constant (see FIGS. 5–9).

For a known tube-launched missile equations 1 through 4 are used to derive a theoretical estimation of the spin turbine 24 parameters. A spin turbine 24, having thickness $t_s$, is then constructed from a selected material such as mild steel with the estimated configurations for the neutral vanes 36 and the lift vanes 38. The spin turbine 24 is then fixedly secured to the selected missile and static fired to generate a torque-time plot (FIGS. 5–9). The area under the empirical torque-time plot is the total torque generated by the spin turbine 24. The material composition and thickness of the spin turbine 24 are selected so that the empirical torque curve has dropped to approximately zero as the missile exits the launch tube.

A five-inch ASMD missile requires an initial spinup to $9\frac{1}{2}$ RPS in approximately 0.3 seconds. Calculations were made to determine the size, shape, angle of attack 40 and number of lift vanes 38 required for a spin turbine 24 capable of delivering an angular torque that would spin an ASMD missile to $9\frac{1}{2}$ RPS in 0.3 seconds, the time required for an ASMD missile to traverse its launch tube. Five spin turbines 24 were fabricated from 1010–1020 steel sheet with the dimensions as shown in Table 1.

TABLE 1

| Test Motor No. | No. Blades | Length mm/in | Height mm/in | Thickness mm/in | Angle | Calculated Peak Torque nm/lb-ft |
|---|---|---|---|---|---|---|
| 1 | 24 | 4.72 | 1.77 | 0.0022 | 20° | 176 |
| | | 1.20 | 0.45 | 0.055 | | 130 |
| 2 | 24 | 2.36 | 0.98 | 0.0022 | 20° | 48 |
| | | 0.60 | 0.25 | 0.055 | | 36 |
| 3 | 12 | 4.72 | 1.77 | 0.0022 | 20° | 88 |
| | | 1.20 | 0.45 | 0.055 | | 65 |
| 4 | 24 | 4.72 | 1.77 | 0.0024 | 20° | 176 |
| | | 1.20 | 0.45 | 0.061 | | 130 |
| 5 | 24 | 4.72 | 1.77 | 0.0016 | 20° | 176 |
| | | 1.20 | 0.45 | 0.040 | | 130 |

The spin turbines 24 were fixedly secured to MK 36 MOD 5 rocket motors and static fired on a torque stand to demonstrate the feasibility of this invention. One rocket motor was test fired without a spin turbine 24 as a control; five other rocket motors were test fired with erodable spin turbines 24 having the varied configurations as delineated in Table 1.

Figure 7:
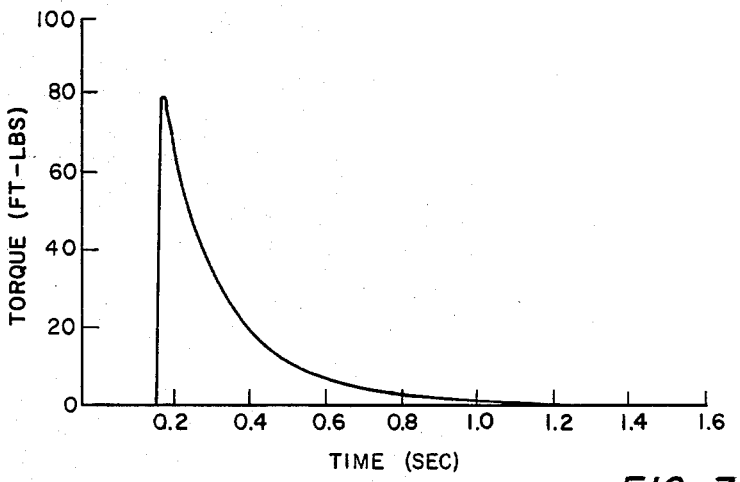
FIG. 7 is the torque-time plot for test motor 3.
Figure 8:
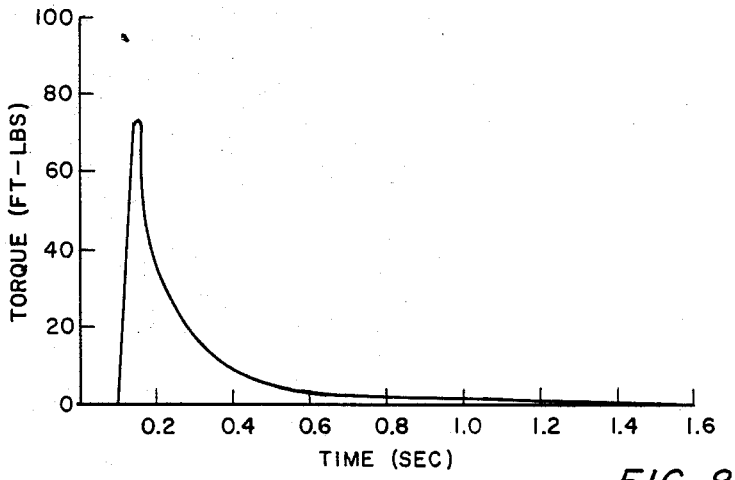
FIG. 8 is the torque-time plot for test motor 4.
Figure 9:
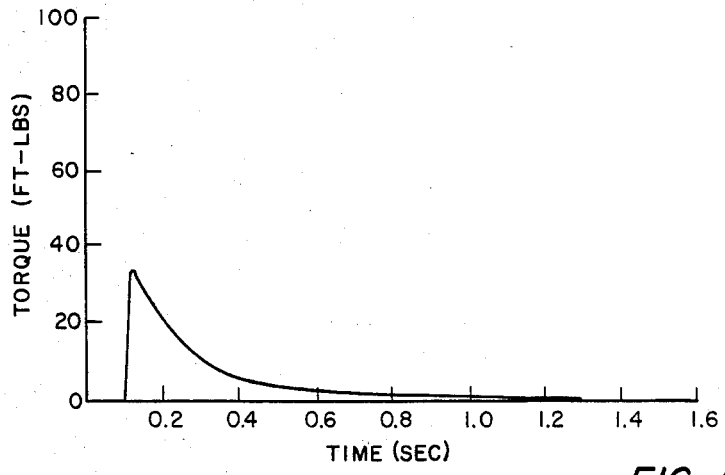
FIG. 9 is the torque-time plot for test motor 5.

Test motor 1 delivered 73 lb-sec less total impulse than the control motor. FIG. 5 shows the torque-time plot for test motor 1; the spin turbine 24 was effectively eroded at approximately 1.4 seconds. Test motor 2 delivered the same total impulse as the control motor. FIG. 6 shows the torque-time plot for test motor 2; the spin turbine was effectively eroded at 1.6 seconds. Test motor 3 burned through its motor casing approximately one second after ignition. The burn through did not affect the results of the torque test because most of the data is obtained in less than one second. Motor performance was normal up to the time of malfunction. FIG. 7 shows the torque-time plot for test motor 3; the spin turbine 24 had not been effectively eroded at the time of burn through of the motor casing. Test motor 4 delivered 13 lb-sec more total impulse than the control motor. FIG. 8 shows the torque-time plot for test motor 4; the spin turbine was effectively eroded at 1.5 seconds. Test motor 5 delivered 77 lb-sec more total impulse than the control motor. FIG. 9 shows the torque-time plot for test motor 5; the spin turbine was effectively eroded at 1.3 seconds. Excluding test motor 3 the spread of the total impulse was 150 lb-sec with the total impulse of the control motor being in the middle of the data spectrum. Only test motor 1 delivered less total impulse than the control motor. The test data showed that any loss of impulse, due to the erodable spin turbine 24, is less than the normal motor-to-motor variation of total impulse and less than ½ percent. As can be seen from the torque-time plots the spin turbines 24 were not effectively eroded at approximately 0.3 seconds and as a result all five erodable spin turbines 24 delivered about twice the angular torque that was calculated. The selection of spin turbine 24 material and the thickness of the spin turbine 24 could now be empirically adjusted so that the spin turbines 24 would be effectively eroded in a shorter time period.

What is claimed and desired to be secured by Letters Patent of the United States is:

1. An improved tube-launched missile of the type having an airframe with canted fins and canards, a payload disposed in the forward end of said airframe, a propellant charge disposed in said airframe aft of said payload, and a nozzle disposed in said airframe aft of said propellant charge for ejecting thrust-producing exhaust gases generated by said propellant charge, wherein the improvement comprises:

an erodable spin turbine in the form of a cylinderical sleeve;

a forward portion of said cylinderical sleeve defining a skirt portion of the nozzle; and, an aft portion of the cylinderical sleeve having a plurality of contiguously disposed axial slits disposed equidistant about the entire cylinderical sleeve and extending forward from its aft extremity for defining a plurality of rearwardly extending tabs therebetween;

each tab being partially bent inwardly about a diagonal bend line defined between adjacent axial slits defining tabs therebetween to form a plurality of neutral vanes and a plurality of lift vanes;

said neutral vanes being integrally colinear with said skirt whereby the exhaust gas stream flows substantially parallel to said neutral vanes;

said lift vanes lying obliquely within the exhaust gas stream whereby the plane of said lift vanes intersecting the axial flow of the exhaust gas stream defines an angle of attack;

whereby said lift vanes are subjected to a lift force due to the flow of the exhaust gas stream across its surface with a component of said force imparting an angular torque to said missile as it traverses its launch tube and the lift vanes are effectively eroding away due to temperature and kinetic energy of exhaust gas impinging thereon.

2. The invention according to claim 1 wherein the spin turbine is formed of mild steel.

3. The invention according to claim 2 wherein the cylinderical sleeve has a thickness in the range of about 40 to 55 thousandths of an inch.

* * * * *